US006086338A

United States Patent [19]

Higgins

[11] Patent Number: 6,086,338

[45] Date of Patent: Jul. 11, 2000

[54] WATER JET INTENSIFIER PUMP HAVING A PISTON ARRANGEMENT WITH A CERAMIC LINER

[75] Inventor: Bobby L. Higgins, Farmers Branch, Tex.

[73] Assignee: Higgins Technologies, Inc., Carrollton, Tex.

[21] Appl. No.: 09/109,599

[22] Filed: Jul. 2, 1998

[51] Int. Cl.[7] ..... F04B 17/00

[52] U.S. Cl. ..... 417/392; 417/403; 92/171.1

[58] Field of Search ..... 417/392, 401, 417/403; 92/171.1

[56] References Cited

U.S. PATENT DOCUMENTS

| | | | |
|---|---|---|---|
| 4,353,683 | 10/1982 | Clark | 417/379 |
| 4,449,446 | 5/1984 | Degnan et al. | 92/146 |
| 4,516,479 | 5/1985 | Vadasz | 92/170.1 |
| 4,574,591 | 3/1986 | Bertsch | 62/6 |
| 4,781,544 | 11/1988 | Leonard et al. | 417/392 |
| 5,092,745 | 3/1992 | Graham | 417/401 |
| 5,152,678 | 10/1992 | Zeck | 417/401 |
| 5,513,962 | 5/1996 | Easton | 417/401 |
| 5,807,083 | 9/1998 | Tomoiu | 417/398 |

*Primary Examiner*—Charles G. Freay
*Assistant Examiner*—Robert Z. Evora
*Attorney, Agent, or Firm*—Locke Liddell & Sapp LLP

[57] ABSTRACT

An intensifier pump for a water jet pump includes an exterior cylinder having a fluid inlet port and a fluid outlet port. A valve is disposed at the fluid outlet port. The intensifier pump includes a piston head and a plunger disposed within the exterior cylinder and which is driven by fluid entering the inlet port. An interior cylinder is disposed within the exterior cylinder. A piston having an anterior plunger is disposed within the interior cylinder and is driven by the plunger for compressing a fluid in a compression chamber to flow through the valve. A ceramic liner is disposed within the interior cylinder and circumferentially disposed around the compression chamber.

2 Claims, 1 Drawing Sheet

WATER JET INTENSIFIER PUMP HAVING A PISTON ARRANGEMENT WITH A CERAMIC LINER

TECHNICAL FIELD OF THE INVENTION

The present invention relates to water jet pumps, and more particularly to an intensifier performing at increased operating pressures.

BACKGROUND OF THE INVENTION

A typical water jet pump operates in a pressure range of up to 60,000 psi. This limit is established by the availability of materials that will withstand pressure cycling without fatigue failures. A typical intensifier pump includes a cylinder pressed on by a fluid, normally oil. This cylinder drives a plunger which displaces a second fluid such as, water, in a compression chamber. The pressure of the fluid in the cylinder causes a force equal to the area of the cylinder multiplied by the pressure in the cylinder. The pressure in a compression chamber driven by a second plunger is raised to a ratio of the area of the cylinder divided by the area of the compression chamber. The output and input of the compressed fluid is regulated by intake and output check valves.

It is desirable that the cylinder within the compression chamber withstand high operating pressures. Cylinders are manufactured by imposing exterior compressive loads on an interior cylinder. This compression causes the interior wall to have a static compressive stress. Other techniques for achieving compressive stress include adding a hoop around the interior cylinder of smaller inside diameter than the outside diameter of the liner. This strain produces a compressive stress in the inner surface of the inside cylinder. Additionally, autofrettage is achieved by imposing a high pressure on the inner surface of a solid cylinder. A compressive stress is therefore applied on the inside of the cylinder wall.

A need has arisen for intensifier pump having an interior cylinder that can withstand increased pressures and cycling loads. Such a pump must be easy to manufacture and maintain.

SUMMARY OF THE INVENTION

In accordance with the present invention, an intensifier pump for a water jet pump includes an exterior cylinder having a fluid inlet port and a fluid outlet port. A valve is disposed at the fluid outlet port. The intensifier pump includes a piston head and a plunger disposed within the exterior cylinder and which is driven by fluid entering the inlet port. An interior cylinder is disposed within the exterior cylinder. A piston having an interior plunger is disposed within the interior cylinder and is driven by the plunger for compressing a fluid in a compression chamber to flow through the valve. A ceramic liner is disposed within the interior cylinder and circumferentially disposed around the compression chamber.

BRIEF DESCRIPTION OF THE DRAWINGS

For a more complete understanding of the present invention and for further advantages thereof, reference is now made to the following Description of the Preferred Embodiments taken in conjunction with the accompanying FIG. 1 which is a sectional view of the present intensifier pump.

DESCRIPTION OF THE PREFERRED EMBODIMENTS

Figure 1:
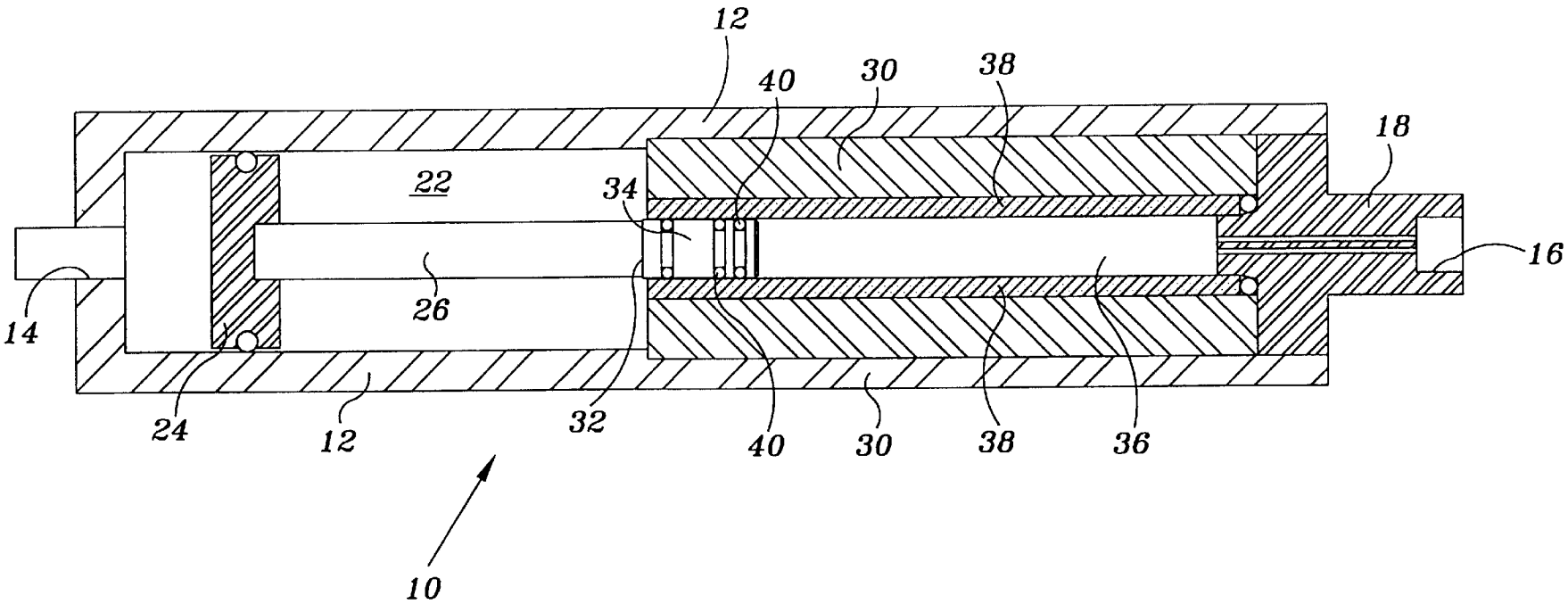

Referring to FIG. 1, the present intensifier pump is illustrated in sectional view, and is generally identified by the numeral 10. Pump 10 includes an exterior cylinder 12 having an inlet port 14 and an outlet port 16. A check valve 18 is disposed at the outlet port 16.

Disposed within exterior cylinder 12 is a hydraulic cylinder 22 having a piston 24 and a plunger 26. Hydraulic cylinder 22 is responsive to fluids such as, for example, oil, entering inlet 14.

Further disposed within exterior cylinder 12 is an interior cylinder 30. Disposed within interior cylinder 30 is a piston 32 having a plunger 34. Piston 32 is actuated by plunger 26 to compress a fluid such as, for example, water within a compression chamber 36. Compressed fluid exits outlet port 16 via check valve 18 of exterior cylinder 12.

An important aspect of the present invention is a ceramic liner 38 disposed within interior cylinder 30. Liner 38 permits interior stresses to be great enough so that the interior of interior cylinder 30 is in compressive stress even though the pressure of the fluid being compressed in chamber 36 is at approximately 80,000 psi. Liner 38 prevents fatigue in interior cylinder 30 as the material comprising interior cylinder 30 never goes through a stress reversal into the tension range. Ceramic liner 38 may include the following specifications:

| | |
|---|---|
| Young's modulus | 75,000,000 psi |
| Yield, tensile | 40,000 psi |
| Yield, compressive | 375,000 psi |

Liner 38 is installed within interior cylinder 30 by expanding the diameter of chamber 36, inserting liner 38, and then compressing the diameter of chamber 36 thereby causing the interior to be in compression greater than the intended pressure of the compression, in the range of, for about, two or three times the compression pressure.

Plunger 34 carries high-pressure seals 40. This configuration reduces longitudinal stresses because the inside diameter of interior cylinder 30 is not increased by seal clearance. Positioning seals 40 on plunger 34 is further advantageous for allowing the bore of interior of cylinder 30 to be less than perfect in straightness, and provides for quick and easy seal replacement.

It therefore can be seen that the present invention provides for an intensifier pump having increased operating pressures and cycling loads which has a reduced number and complexity of fittings and attachments.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. An intensifier pump for a water jet pump comprising:

an exterior cylinder having a fluid inlet port and a fluid outlet port;

a valve disposed at said fluid outlet port;

a first piston having a first plunger disposed within said exterior cylinder and driven by fluid entering said inlet port;

an interior cylinder having a compression chamber disposed within said exterior cylinder, said interior cylinder having a first diameter;

a second piston having a second plunger disposed within said interior cylinder and driven by said first plunger for compressing a fluid in said compression chamber to flow through said valve; and a ceramic liner disposed within said interior cylinder and circumferentially disposed around said compression chamber, said interior cylinder having a second diameter, less than said first diameter, with said ceramic liner disposed within said interior cylinder, said interior cylinder thereby compressing said ceramic liner, such that said ceramic liner is continuously under compression during operation of said pistons and experiences no stress reversal during operation of the intensifier pump.

2. The intensifier pump of claim 1 and further including seals disposed on said second plunger for engaging said ceramic liner.

* * * * *